US008006739B2

(12) United States Patent
Costello

(10) Patent No.: US 8,006,739 B2
(45) Date of Patent: Aug. 30, 2011

(54) ARCHITECTURAL MESH SUNSCREEN WITH VARYING SHADING CHARACTERISTIC

(75) Inventor: Thomas Costello, Annapolis, MD (US)

(73) Assignee: Cambridge International Inc., Cambridge, MD (US)

( * ) Notice: Subject to any disclaimer, the term of this patent is extended or adjusted under 35 U.S.C. 154(b) by 1 day.

(21) Appl. No.: 11/315,312

(22) Filed: Dec. 23, 2005

(65) Prior Publication Data

US 2007/0144101 A1 Jun. 28, 2007

(51) Int. Cl.

| | |
|---|---|
| ***A47G 5/00*** | (2006.01) |
| ***B21F 27/08*** | (2006.01) |
| ***B21F 31/00*** | (2006.01) |
| ***E04H 17/02*** | (2006.01) |

(52) U.S. Cl. ..... 160/351; 160/332; 256/45; 256/33; 245/3; 245/4

(58) Field of Classification Search ..... 256/32, 256/33, 45; 52/633; 160/332, 350, 351; 245/3, 4, 9

See application file for complete search history.

(56) References Cited

U.S. PATENT DOCUMENTS

| | | | | |
|---|---|---|---|---|
| 538,040 A | | 4/1895 | Hilton | |
| 868,244 A | * | 10/1907 | Backlin | 256/45 |
| 889,312 A | | 6/1908 | Kahn - | |
| 1,145,833 A | * | 7/1915 | English et al. | 473/190 |
| 1,371,820 A | * | 3/1921 | Sochurek | 473/190 |
| D61,098 S | | 6/1922 | Lown | |
| 1,466,680 A | | 9/1923 | Timm | |
| D89,866 S | | 6/1933 | Beam | |
| 2,172,112 A | * | 9/1939 | Sommer | 245/7 |
| 2,313,533 A | | 3/1943 | Gersman | |
| D168,946 S | | 3/1953 | Liskey, Jr. | |
| D186,407 S | | 10/1959 | Fuller | |
| D186,467 S | | 10/1959 | Cooper | |
| D189,156 S | | 11/1960 | Hallock | |
| D189,401 S | | 12/1960 | Alvord et al. | |
| D191,845 S | | 11/1961 | Ries | |
| D192,652 S | | 4/1962 | Seery | |
| D193,684 S | | 9/1962 | Ries | |
| 3,859,865 A | * | 1/1975 | Conrad | 198/840 |
| 4,234,907 A | | 11/1980 | Daniel | |
| 4,396,041 A | * | 8/1983 | Daringer | 140/3 R |
| 4,511,146 A | * | 4/1985 | Windall | 473/192 |
| 4,573,432 A | | 3/1986 | Boxhorn et al. | |
| 4,625,140 A | | 11/1986 | Gagnon | |
| 4,673,166 A | * | 6/1987 | MacDougall | 256/11 |
| 4,752,114 A | | 6/1988 | French | |
| 4,907,132 A | | 3/1990 | Parker | |
| 4,912,889 A | | 4/1990 | Palumbo | |

(Continued)

FOREIGN PATENT DOCUMENTS

WO WO 2004/088059 * 10/2004

*Primary Examiner* — Michael Safavi

(74) *Attorney, Agent, or Firm* — Buchanan Ingersoll & Rooney PC

(57) ABSTRACT

An architectural mesh sunscreen panel having at least a first portion including a first architectural mesh assembled from a plurality of first interwoven helically-wound spiral units and first connector rods; and a second portion including a second architectural mesh assembled from a plurality of second interwoven helically-wound spiral units and second connector rods. The first architectural mesh defines a first shading characteristic that is different from a second shading characteristic defined by the second architectural mesh.

15 Claims, 4 Drawing Sheets

U.S. PATENT DOCUMENTS 5,021,928 A 6/1991 Daniel
D318,148 S 7/1991 Peltier
5,066,085 A 11/1991 Gimbutas et al.
5,183,323 A 2/1993 Daniel
5,256,468 A 10/1993 Wiener
D364,277 S 11/1995 Worral
5,485,355 A 1/1996 Voskoboinik et al.
5,577,712 A * 11/1996 White, Jr. ..... 256/7
5,701,236 A 12/1997 Viviano
5,879,069 A 3/1999 Chien
5,887,856 A 3/1999 Everly, II
6,021,702 A * 2/2000 Rexroad ..... 87/12
6,041,916 A 3/2000 Daringer et al.
6,206,347 B1 * 3/2001 Kelley ..... 256/47
6,464,381 B2 10/2002 Anderson, Jr. et al.
6,628,885 B1 9/2003 Wilkie et al.
D483,953 S * 12/2003 Ripple ..... D5/1
6,793,360 B2 9/2004 Goslee
2004/0036063 A1 * 2/2004 Ferraiolo ..... 256/32
2004/0047142 A1 * 3/2004 Goslee ..... 362/84
2006/0075699 A1 * 4/2006 Messick, Jr. et al. ..... 52/202
2006/0090862 A1 * 5/2006 Messick, Jr. ..... 160/330
2006/0188705 A1 * 8/2006 Fletcher ..... 428/304.4

* cited by examiner

ARCHITECTURAL MESH SUNSCREEN WITH VARYING SHADING CHARACTERISTIC

TECHNICAL FIELD

The present invention is directed to an architectural mesh sunscreen and, more particularly, to an architectural mesh sunscreen panel assembled from a combination of woven wire meshes to produce the overall desired shading characteristics.

BACKGROUND OF THE INVENTION

Architectural meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration. Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented.

Accordingly, as the requirement for incorporating energy savings into building design increases, and hence the need for architecturally acceptable sun shading or screening increases, architectural mesh offers a variety of options that can meet the shading needs while still maintaining architectural requirements.

It would be desirable to have available options for varying the aesthetic appearance of an architectural mesh product, and particularly with respect to its application as a sun screen, to vary the aesthetic appearance without detracting from the desired sun shading characteristics thereof.

BRIEF DESCRIPTION OF THE DRAWINGS

These and other objects, features, and advantages of the present invention will become more readily apparent to those skilled in the art upon reading the following detailed description, in conjunction with the appended drawings in which.

DETAILED DESCRIPTION OF THE PREFERRED EMBODIMENT

Figure 1:
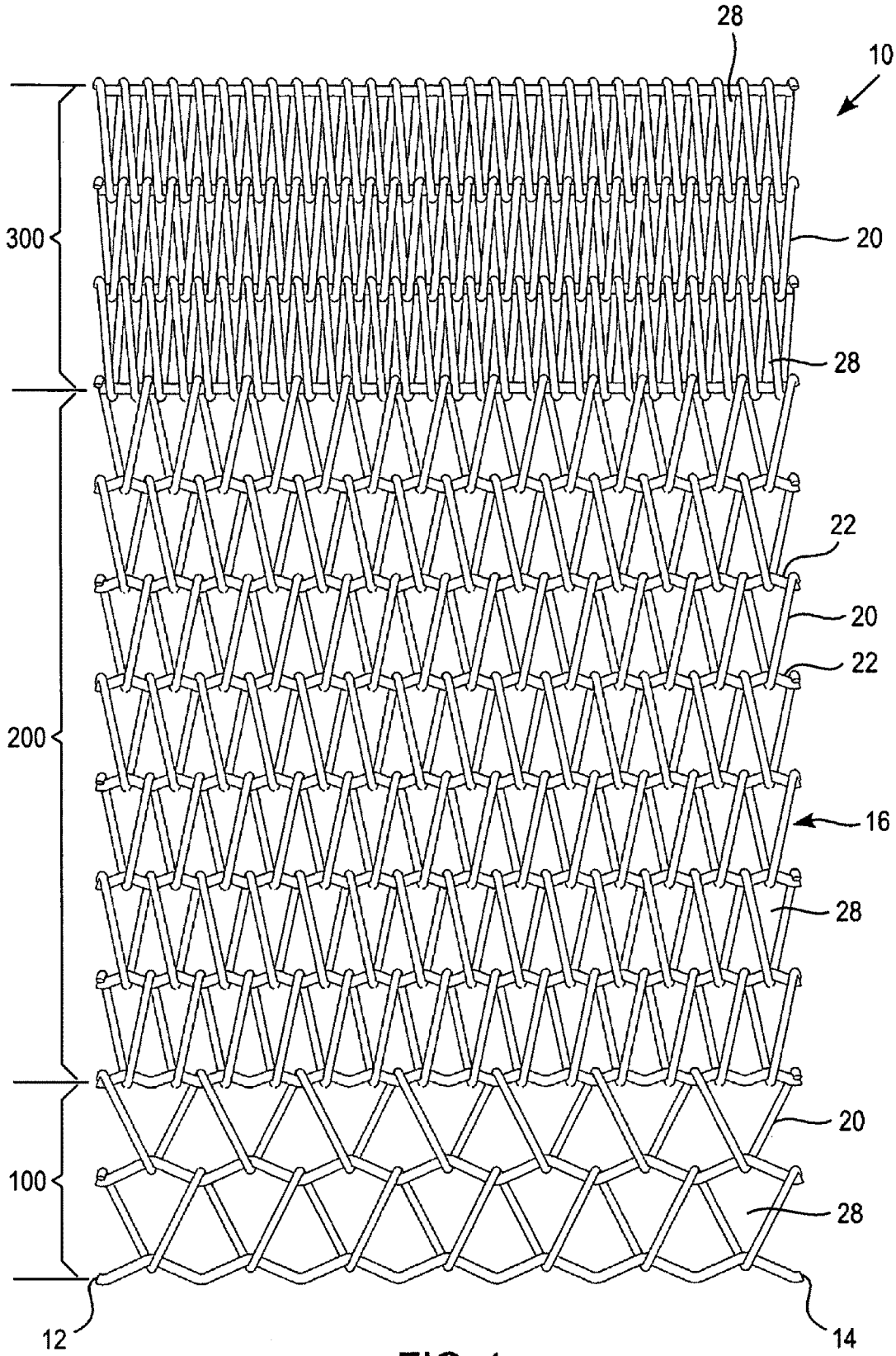
FIG. 1 is a plan view of a combination architectural mesh sunscreen panel in accordance with the present invention.

A portion of an architectural mesh sunscreen panel in accordance with the present invention is shown generally in FIG. 1 by reference numeral 10. The architectural mesh panel 10 is preferably comprised of a combination of two or more different woven meshes. As shown in the illustrated embodiment, panel 10 includes a first woven mesh portion 100, a second woven mesh portion 200, and a third woven mesh portion 300. The panel 10 has laterally (transversally) opposite, i.e., left and right, vertically extending edges 12, 14, and is of indeterminate length in the longitudinal direction (parallel to the edges 12, 14). In assembling the woven wire architectural mesh, a single helically-wound spiral wire, such as 20 in FIG. 1, is associated with two connector rods 22 positioned to be sequentially adjacent in the vertical direction of the architectural mesh panel 10 and to thereby define a spiral unit or row 16. The combination of a helically-wound spiral and two associated connector rods defines a plurality of widthwise side-by-side open recesses 28

Figure 2:
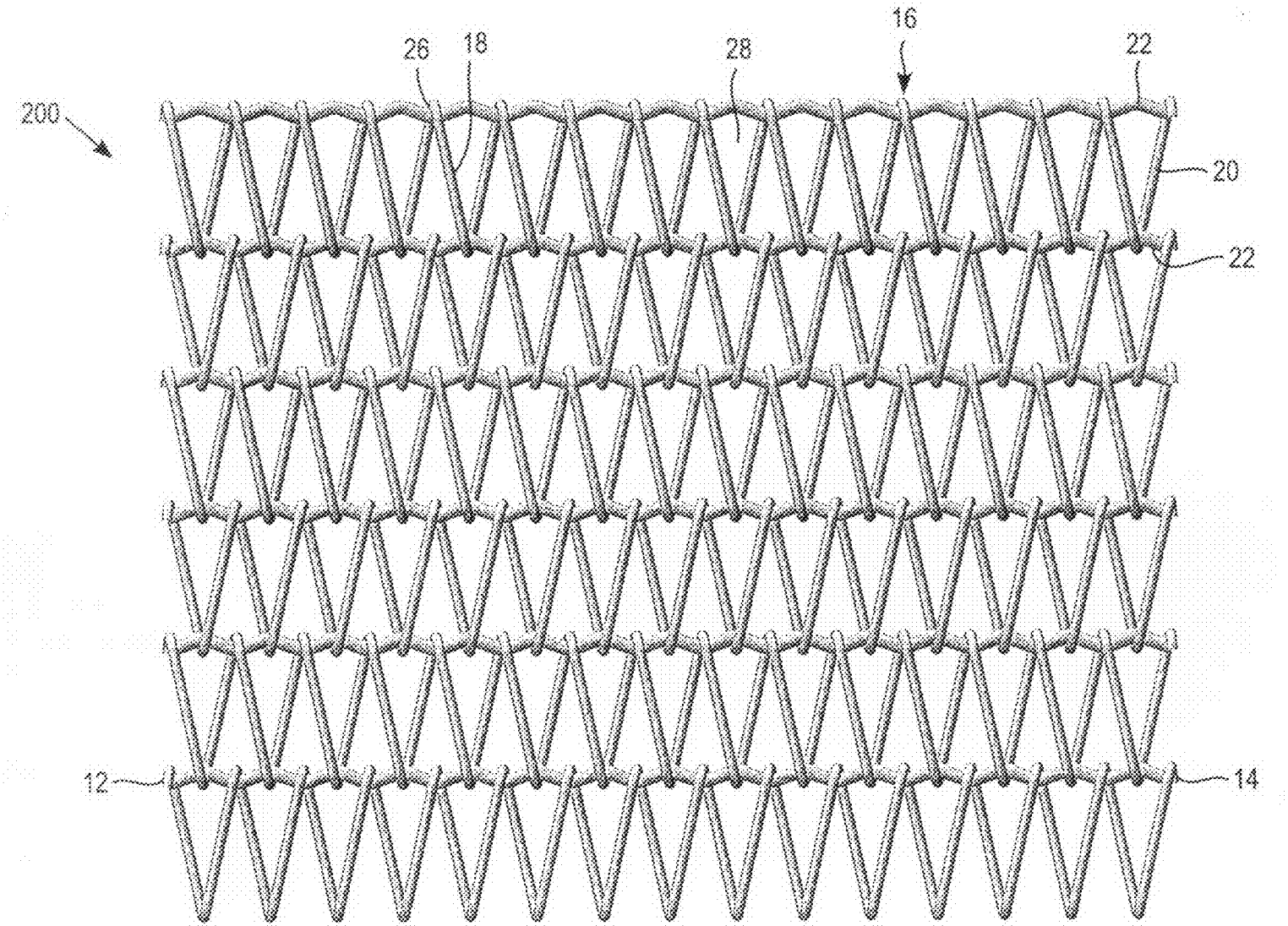
FIG. 2 is a plan view of a portion of the architectural mesh panel shown in FIG. 1.

Referring also to FIG. 2, an enlarged view of second portion 200 is provided by way of example regarding the construction details of architectural mesh panel 10; it be apparent to one skilled in the art that such details would also apply to first portion 100 and third portion 300 of the panel 10. Architectural mesh panel 10 is composed of a longitudinally extending series of transversally extending flat spiral wire units 16, alternate ones of which spiral in a left-handed sense and a right-handed sense. Spiral turns 18 of the units 16 turn around respective connecting rods 22, in respective crimp notches 26 in the rods 22. The notches 26 face upwards and downwards, in the plane of the architectural mesh. The notches extend on axes which are not perpendicular to the plane of the mesh panel 10. Rather, on alternate ones of the rods 22, they are tilted to the left, and tilted to the right. On each rod, the notches 26 are provided in two series, one opening upwards, and another, diametrically opposed set, opening downwards. On each rod, the notches 26 of the two sets are staggered, one on one side being located half-way between two on the other side, but all are tilted in the same direction, i.e., all towards the left on both sides of one rod, and all towards the right on both sides of the next rod. Accordingly, spiral units 16 of opposite hand need to be wound in opposite directions, whereas connecting rods 22 can be manufactured as one type and simply alternately turned side to side in order to provide the two types needed.

FIG. 1 thus illustrates a combination of "balanced" woven wire architectural meshes having vertically disposed alternate left-handed and right-handed helically-wound spirals in the height direction of the architectural mesh panel.

Typically, both the spiral wire units 16 and connecting rods 22 are manufactured from indeterminate lengths of steel wire material acquired as coils, and are not cut to length until after they have been provided with the above-described shapes as known in the art for forming woven wire products. The architectural mesh panel 10 may also be woven from a combination of spiral wire units of two or more different metals, for example, brass and stainless steel, a combination selected from stainless steel, aluminum, brass, bronze and copper, or the mesh may be woven using spiral wire units that are made from the same material. Similarly, all of the wires may be the same size or shape, or they may have different characteristics.

Referring to FIG. 2, the open recesses 28 in second portion 200 of architectural mesh panel 10 define a 59% open area per square foot of mesh. The balanced weave mesh of second portion 200 is known in the art as B-24-12-12-14 mesh. The first number or count in this description refers to the spread, or loops/foot in the widthwise direction. The second number or count refers to the pitch, or spirals/foot, the third number refers to the wire gauge of the connecting rods, and the fourth number refers to the wire gauge from which the spiral units are formed. If an architectural mesh sunscreen panel were formed entirely of the balanced weave mesh shown second portion 200 of panel 10, the resulting architectural panel would exhibit 59% open area/square foot. While this may be acceptable for some sunscreen applications, when greater or less shading requirements are desired, other percentages of open area must be provided.

Figure 3:
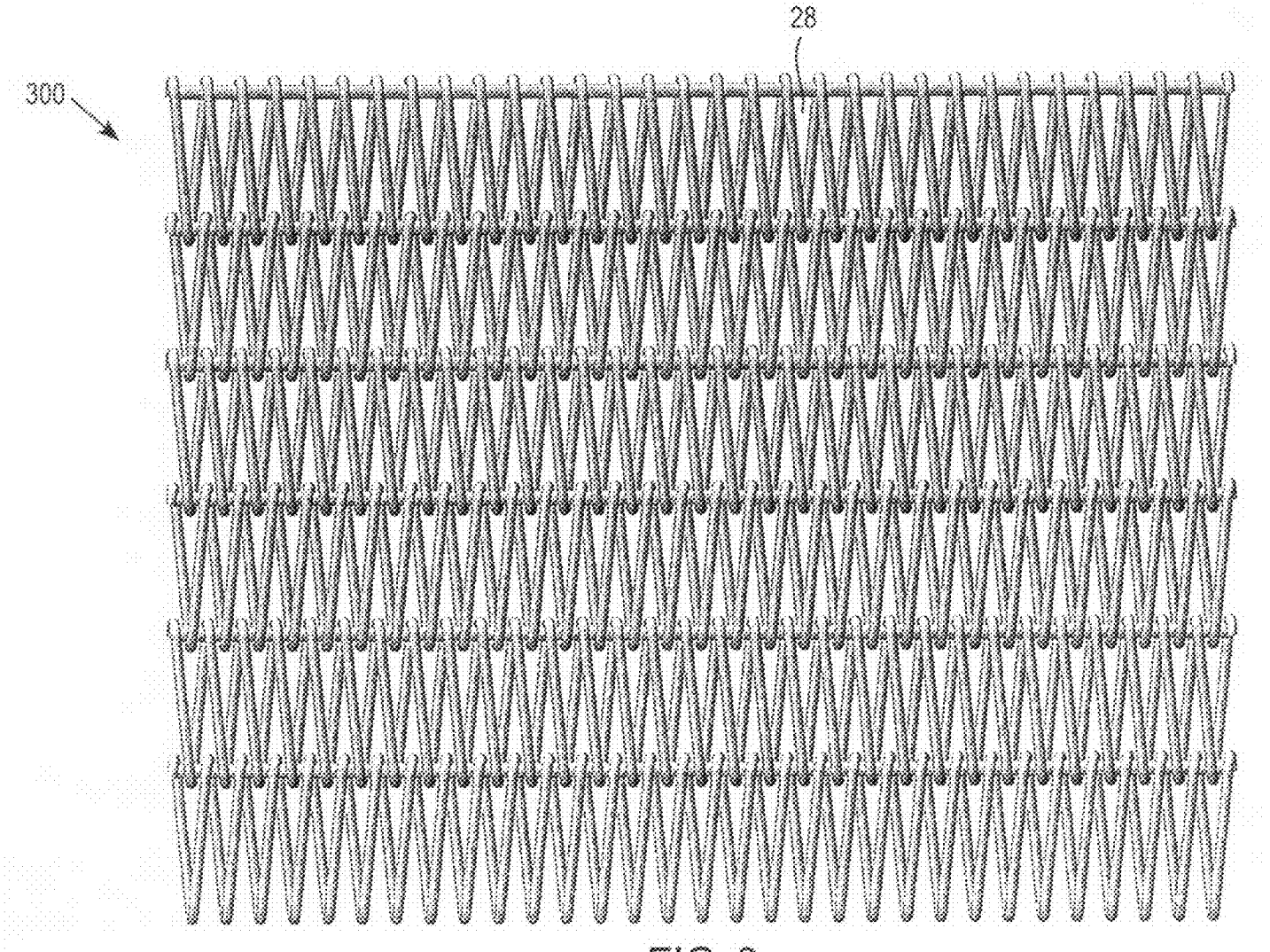
FIG. 3 is a plan view of another portion of the architectural mesh panel shown in FIG. 1.

The third portion 300 of the architectural mesh panel 10 shown in FIG. 1 provides a shading characteristic based upon having 23% open area/square foot. The mesh of third portion 300, as shown in an enlarged view in FIG. 3 is known in the art as a B-48-12-12-14 mesh. By combining rows of B-24-12-12-14 mesh, portion 200 as shown in FIG. 2, and rows of B-48-12-12-14 mesh, portion 300 as shown in FIG. 3, a sunscreen panel can be customized to have a desired shading characteristic based upon the overall percentage of open area within the panel.

Figure 4:
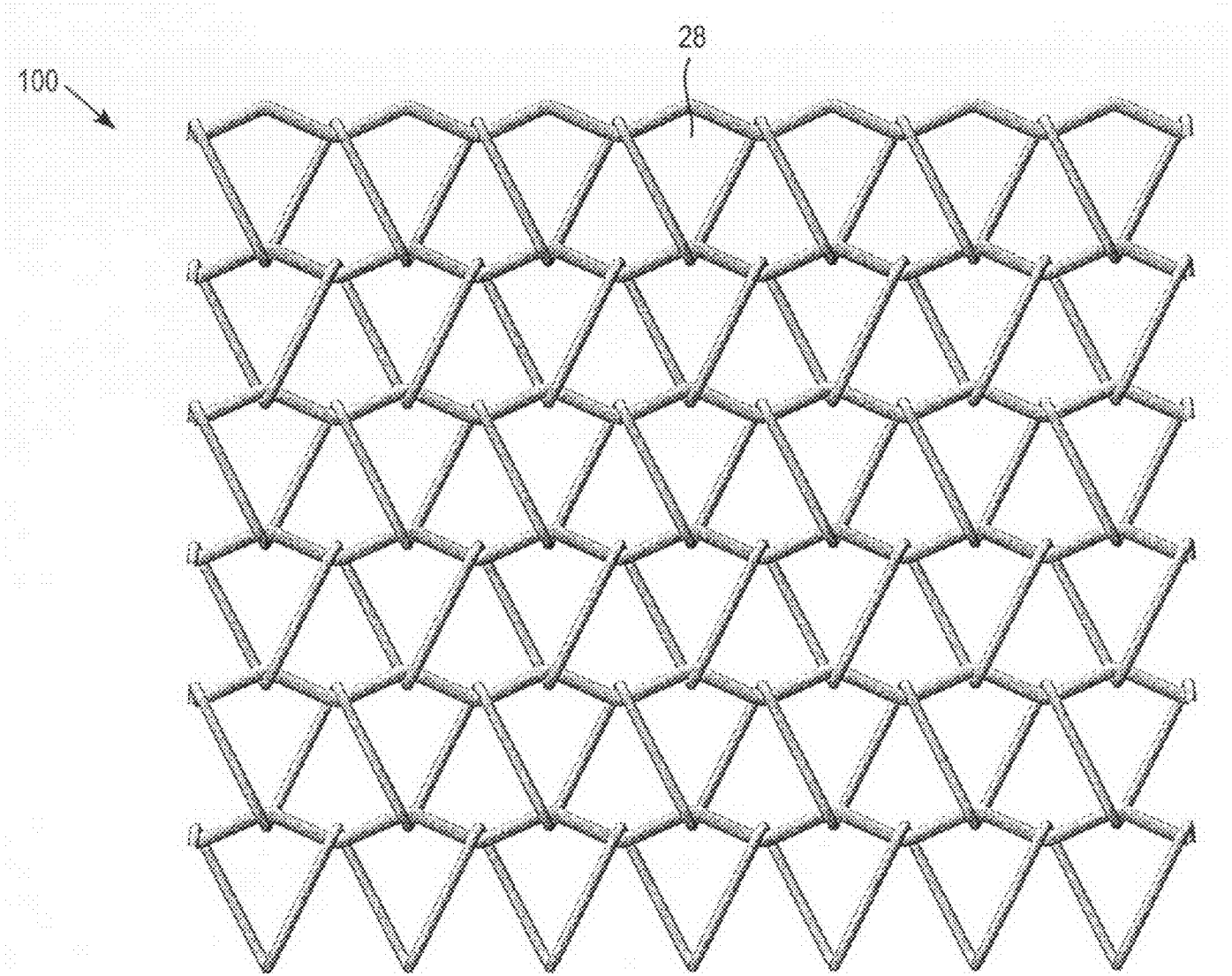
FIG. 4 is a plan view of yet another portion of the architectural mesh panel shown in FIG. 1.

Referring to FIG. 4, an enlarged view of first portion 100 of architectural mesh panel 10 is illustrated. The mesh shown in FIG. 4 provides a shading characteristic based upon having 74% open area/square foot and is described in the art as a B-12-12-12-14 mesh.

FIG. 1 illustrates architectural mesh sunscreen panel 10 in accordance with the present invention. As shown, the sunscreen panel 10 includes a first portion 100 having the characteristics of the mesh of FIG. 4, a second portion 200 having the characteristics of the mesh of FIG. 2, and a third portion 300 having the characteristics of the mesh of FIG. 3. By combining the various woven meshes having varying percentages of open areas per square foot, the overall open area per square foot of panel 10 may be calculated by first multiplying the percentage of open area for each mesh component (i.e., portions 100, 200, 300) by the number of spiral units or rows 16 in the overall panel 10 per lineal foot divided by the second number (or count) of the component mesh, i.e. for a B-24-12-12-14 mesh, the second count is 12, and by then adding the results obtained for each of the component meshes.

EXAMPLE

Portion 100: two rows of B-12-12-12-14 having a 74% open area

Portion 200: seven rows of B-24-12-12-14 having a 59% open area

Portion 300: three rows of B-48-12-12-14 having a 23% open area

The second number or count for each portion of mesh panel 10 is "12".

Term 1 =74% ×(2 rows/12) =12.33%

Term 2 =59% ×(7 rows/12) =34.40%

Term 3 =23% ×(3 rows/12) =5.75%

Adding together Terms 1-3, the overall open area for combined panel 10 would be calculated as 52.48% .

Although three specific weaves of woven wire mesh have been described herein, the present invention is not limited to combinations involving only the illustrated embodiments. It will be clear to one skilled in the art that by providing a number of standard mesh weaves, preferably at least two and most preferably three, a multitude of sunscreen panels can be produced having a broad range of shading characteristics. Preferably, based upon the three preferred mesh weaves disclosed herein, combinations thereof could be assembled to achieve a desired percentage of open area per square foot ranging from approximately ,10% open area/square foot to approximately 90% open area/square foot. These percentages may be further refined by also providing each of the standard weave meshes in two different pitches, i.e., a different count for the second number, thus allowing even more flexibility in providing the desired shading.

While the present invention has been described with respect to particular embodiments of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

The invention claimed is:

1. An architectural mesh sunscreen panel, comprising:

a first portion including a first architectural mesh assembled from a plurality of first interwoven helically-wound spiral units comprising a first spiral wound wire winding about first connector rods, wherein each said first helically wound spiral unit extends in a transverse direction of the architectural mesh panel and is associated with only two of said connector rods, said only two connector rods being positioned sequentially adjacent in a vertical direction of the architectural mesh sunscreen panel; and a second portion including a second architectural mesh assembled from a plurality of second interwoven helically-wound spiral units comprising a second spiral wound wire winding about second connector rods, wherein each said second helically wound spiral unit extends in a transverse direction of the architectural mesh panel and is associated with only two of said second connector rods, said only two second connector rods being positioned sequentially adjacent in a vertical direction of the architectural mesh sunscreen panel;

wherein said first connector rods are different from said second connector rods;

wherein said first architectural mesh and said second architectural mesh are joined along a common connector rod such that an uppermost edge of an uppermost one of said second interwoven helically-wound spiral units and a lowermost edge of a lowermost one of said first interwoven helically-wound spiral units wind about said common connector rod;

wherein the first architectural mesh defines a first shading characteristic of the architectural mesh sunscreen panel that is different from a second shading characteristic of the architectural mesh sunscreen panel defined by the second architectural mesh;

wherein when the second shading characteristic is greater than the first shading characteristic, said common connector rod is defined by one of said second connector rods.

2. The architectural mesh sunscreen panel according to claim 1 wherein the plurality of first interwoven helically-wound spiral units and the first connector rods form a plurality of widthwise side-by-side first open recesses, said plurality of first open recesses defining said first shading characteristic as a predetermined open area per square foot of said first architectural mesh.

3. The architectural mesh sunscreen panel according to claim 2 wherein the plurality of second interwoven helically-wound spiral units and the second connector rods form a plurality of widthwise side-by-side second open recesses, said plurality of second open recesses defining said second shading characteristic as a predetermined open area per square foot of said second architectural mesh.

4. The architectural mesh sunscreen panel according to claim 3 wherein said predetermined open area per square foot of said first architectural mesh is greater than said predetermined open area per square foot of said second architectural mesh.

5. The architectural mesh sunscreen panel according to claim 4 wherein said predetermined open area per square foot of said first architectural mesh is between approximately 10% and 90%.

6. The architectural mesh sunscreen panel according to claim 4 wherein said predetermined open area per square foot of said second architectural mesh is between approximately 10% and 90%.

7. The architectural mesh sunscreen panel according to claim 4 wherein said predetermined open area per square foot of said first architectural mesh is 74% and said predetermined open area per square foot of said second architectural mesh is 23%.

8. The architectural mesh sunscreen panel according to claim 1 further comprising a third portion including a third architectural mesh assembled from a plurality of third interwoven helically-wound spiral units and third connector rods, wherein the third architectural mesh defines a third shading characteristic that is different from said first and second shading characteristics.

9. The architectural mesh sunscreen panel according to claim 8 wherein the plurality of third interwoven helically-wound spiral units and the third connector rods form a plurality of widthwise side-by-side third open recesses, said plurality of third open recesses defining said third shading characteristic as a predetermined open area per square foot of said third architectural mesh.

10. The architectural mesh sunscreen panel according to claim 1, wherein the first architectural mesh and the second architectural mesh provide sun shading for a building so as to thereby save energy.

11. The architectural mesh sunscreen panel according to claim 1, wherein each said first helically wound spiral unit includes a plurality of spiral turns, each said spiral turn turning around one of said two connector rods along the length of said connector rod.

12. The architectural mesh sunscreen panel according to claim 11, wherein said connector rods include a plurality of crimp notches, each said spiral turn being seated in a respective crimp notch on said connector rod.

13. The architectural mesh sunscreen panel according to claim 1, wherein at least one of said first helically wound spiral units is transversely offset from an adjacent said first helically wound spiral unit such that said first spiral wound wire of said at least one first helically wound spiral unit extends around one of said first connector rods approximately in the middle between where said first spiral wound wire of said adjacent first helically wound spiral unit extends around said one of said first connector rods and wherein at least one of said second helically wound spiral units being transversely offset from an adjacent said second helically wound spiral unit such that said second spiral wound wire of said at least one second helically wound spiral unit extends around one of said second connector rods approximately in the middle between where said second spiral wound wire of said adjacent second helically wound spiral unit extends around said one of said second connector rods.

14. The architectural mesh sunscreen panel according to claim 13, wherein said at least one first helically wound spiral unit transversely offset from said adjacent said first helically wound spiral unit is a right-hand helically wound spiral unit and said adjacent first helically wound spiral unit is a left-hand helically wound spiral unit.

15. The architectural mesh sunscreen panel according to claim 14, wherein said at least one second helically wound spiral unit transversely offset from said adjacent said second helically wound spiral unit is a right-hand helically wound spiral unit and said adjacent second helically wound spiral unit is a left-hand helically wound spiral unit.

* * * * *